US006527629B1

(12) United States Patent
Sandvold

(10) Patent No.: US 6,527,629 B1
(45) Date of Patent: Mar. 4, 2003

(54) GRINDING DEVICE FOR ROUNDING OFF EDGES OF AN OPENING IN A WORK PIECE

(75) Inventor: Arne Sandvold, Hunndalen (NO)

(73) Assignee: Grobi AS (NO)

( * ) Notice: Subject to any disclaimer, the term of this patent is extended or adjusted under 35 U.S.C. 154(b) by 0 days.

(21) Appl. No.: 09/647,679

(22) PCT Filed: Mar. 30, 1999

(86) PCT No.: PCT/NO99/00108

§ 371 (c)(1),
(2), (4) Date: Oct. 12, 2000

(87) PCT Pub. No.: WO99/51395

PCT Pub. Date: Oct. 14, 1999

(30) Foreign Application Priority Data

Apr. 3, 1998 (NO) ..... 19981535

(51) Int. Cl.[7] ..... B24B 21/00
(52) U.S. Cl. ..... 451/296; 451/299
(58) Field of Search ..... 451/296, 297, 451/299, 310, 302, 350, 354, 355, 64, 75, 89, 491, 513

(56) References Cited

U.S. PATENT DOCUMENTS

| | | | | |
|---|---|---|---|---|
| 1,257,691 A | | 2/1918 | Fraser | |
| 2,431,795 A | | 12/1947 | Elmes | |
| 3,991,522 A | * | 11/1976 | Hedlund et al. | 451/65 |
| 4,091,573 A | * | 5/1978 | Schmidt | 451/302 |
| 4,843,764 A | * | 7/1989 | Bando | 451/260 |
| 5,772,496 A | * | 6/1998 | Kurtz et al. | 451/296 |
| 6,299,517 B1 | * | 10/2001 | Weber | 451/309 |
| 6,325,707 B1 | * | 12/2001 | Rambeau | 451/296 |

FOREIGN PATENT DOCUMENTS

| | | |
|---|---|---|
| DE | 3322211 | 1/1985 |
| FI | 29600 | 8/1958 |

* cited by examiner

*Primary Examiner*—Joseph J. Hail, III
*Assistant Examiner*—David B. Thomas
(74) *Attorney, Agent, or Firm*—Nixon & Vanderhye PC

(57) ABSTRACT

An apparatus for rounding off edges of openings in a work piece, such as internal openings or cut outs in steel plates. The apparatus includes a belt grinding machine having a continuous grinding belt running over several belt guiding rollers which are provided on a support frame. Two of the rollers are provided on a cradle, that is pivotally supported in the support frame. The grinding belt is, between the rollers on the cradle, disposed for rectilinear working of the work piece, and a device is arranged for operating the cradle in a pendulum like movement about the pivotal support during a grinding operation.

20 Claims, 3 Drawing Sheets

GRINDING DEVICE FOR ROUNDING OFF EDGES OF AN OPENING IN A WORK PIECE

Figure 1:
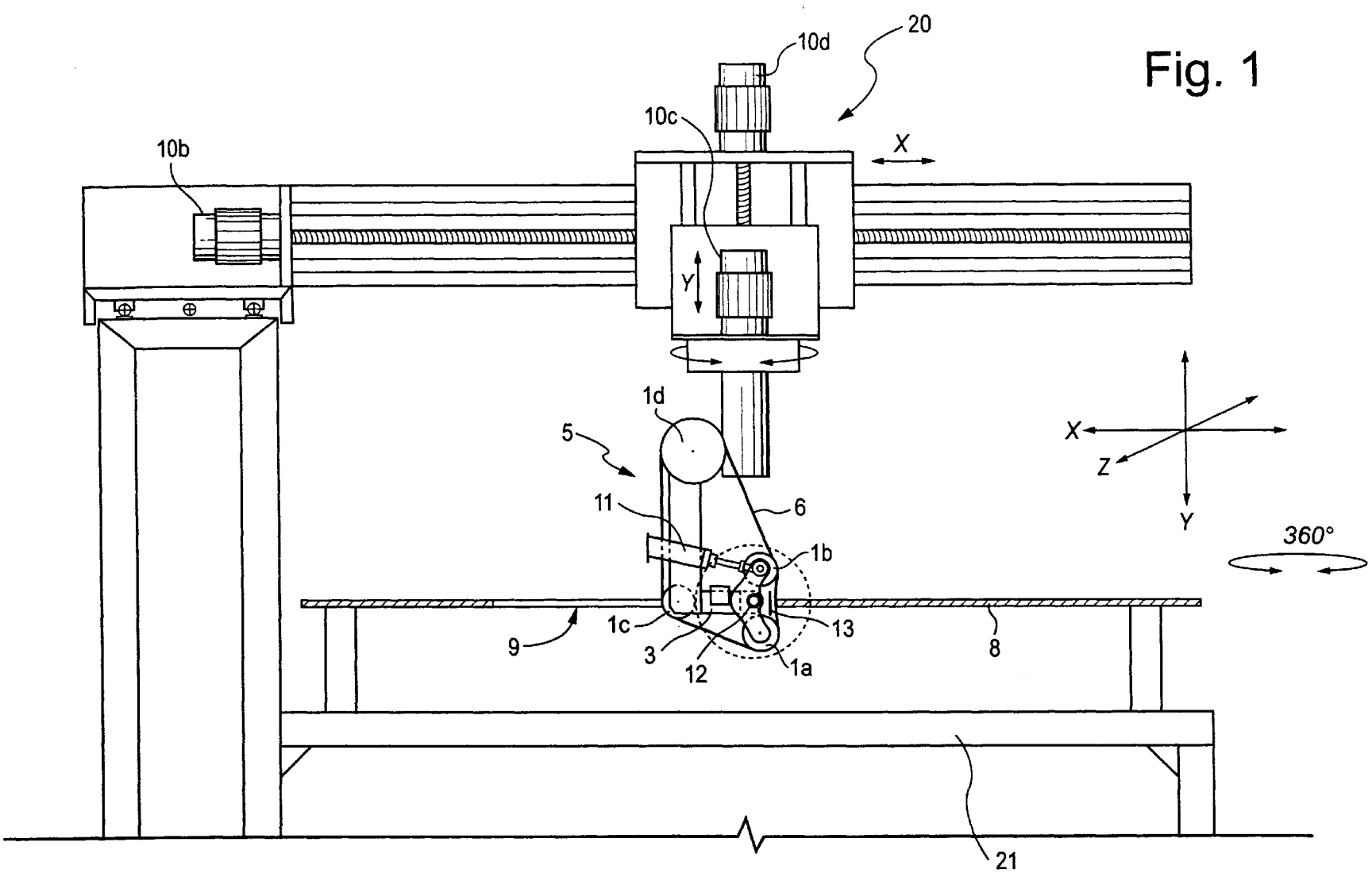

The present invention relates to a device for rounding off edges of an opening in a work piece, like internal openings in steel plates, which device comprises a belt grinding machine having a continuous grinding belt running over several belt guiding rollers, which are provided on a support frame.

The demands to maintenance and safety increase both in the marine environment and within land based industrial activity. Corrosion protection of steel, either it be platforms, ships or steel bridges on shore, are getting increasingly important. Veritas, oil companies, Norsok, road authorities, etc. are specifying requirements regarding roundness of sharp edges and removal of temper zones. Temper zones appear when steel plates are cut with autogenous or plasma equipment. The temper zones do often have to be removed because the surface is to be sand blasted or metallized.

Thus it is observed a need to develop a machine for rounding off edges of openings cut out in steel plates. At first hand one have in mind steel plates for the ship yard industry. The edges are to be rounded off along the edge of the opening at the top side and under side. In order to be able to do so, the machine has to be provided with sensors and positioning units such that the grinding head automatically follows the edge of the opening. The openings may per se be of arbitrary shape.

The situation at present is that goods of this type are ground with small angle grinders and other hand held tools. This is performed manually and the process is dusty and noisy in addition to that the working posture is immensely disadvantageous. The manual operation is time consuming and thus costly.

By the suggested machine the productivity will be increased, the quality of the ground edge and the working environment will be improved, a more favourable working strain for the operator will be given, and dust and noise be less. Further, it will be possible to provide an effective dust suction on this equipment. It will be difficult/impossible to provide an effective suction on present angle grinders.

As it comes to the grinding process proper, it is natural that the grinding operation has to be adapted to the material that is to be ground. Thus there is a large difference between grinding of wood work and steel material. Grinding processes that are developed for wood material can thus not without more ado be used when grinding steel or metals. To better understand the background for the present invention, some aspects are listed to make a comparison between grinding of wood work and steel material:

Wood Work

Soft material

Easy to work on, i.e. low grinding press. The force by which the grinding belt is pressed against the work piece is moderate. This means little belt tension.

Use of relatively fine grained grinding belt, which thus is also flexible, i.e. easy to bend around an edge.

Relatively lower speed of the grinding belt, i.e. in relation to grinding of steel.

Steel Material

Hard material

Heavier to work on, increased grinding press. This means higher motor rating and thus high tension in the grinding belt.

Use of coarser grinding belts, which are not flexible, i.e. hard to bend around an edge.

High speed of the grinding belt, approx. 40 m/sec.

In grinding steel material the easiest would be to bend the belt around the sharp edge to be ground. This is possible when wood work is to be ground, but gets in practise impossible on a steel material because:

The grinding belt is not that flexible that it can be bent much around the edge.

No controls of the grinding press.

High motor rating will tense the belt which thus is straightening out between the guide rollers.

To take care of the problems indicated above, is a device of the introductory described type provided, for rounding off edges of openings in a work piece, which device is distinguished in that two of the rollers are arranged on a cradle, which cradle is pivotally supported in the support frame, that the grinding belt between the rollers on the cradle endeavour to run substantially rectilinear for working off the work piece and that means are provided for operating the cradle about the pivotal support during a grinding operation.

Conveniently is a counter support, or a grinding shoe, provided in back of the grinding belt and between the belt guiding rollers on the cradle. The cradle can be adjustable in the vertical direction and be arranged symmetrically in respect of a horizontal plane extending through the pivotal axis of the cradle.

Further, the operating means may be a linear acting motor which in one end thereof is fixed to the support frame and in the other end thereof is pivotally fixed to the cradle. The linear motor can be in form of a double acting ram, or working cylinder, which actively causes a form of oscillating movement of the cradle by extending respectively retracting the piston rod of the ram.

The belt grinder may preferably include an upper and lower guiding wheel on the cradle, an upper driving wheel and a lower turning wheel fixed to the support frame.

The support frame can be provided with a telemeter for continuously measuring of the distance to the plate edge to achieve proper positioning of the cradle in respect of the plate edge.

It will be of convenience that the belt grinding machine is mounted to a co-ordinate machine having a co-ordinate table for the work piece. Thus the belt grinding machine in the co-ordinate machine will be displaceable in the x, y and z-direction. As an option, the co-ordinate table can be displaceable in one or more of the said directions.

Experiences from tests of such an edge rounding device in the work shop that is based on the principle that the belt oscillate around the edge at the top side and under side of the plate, has shown that the following advantages are achieved:

1. One may use a stiff grinding belt which do not have to bend around the edge.

2. The grinding press may in some extent be controlled dependent of how heavily the pair of oscillating wheels is forced against the piece that is ground.

Figure 2:
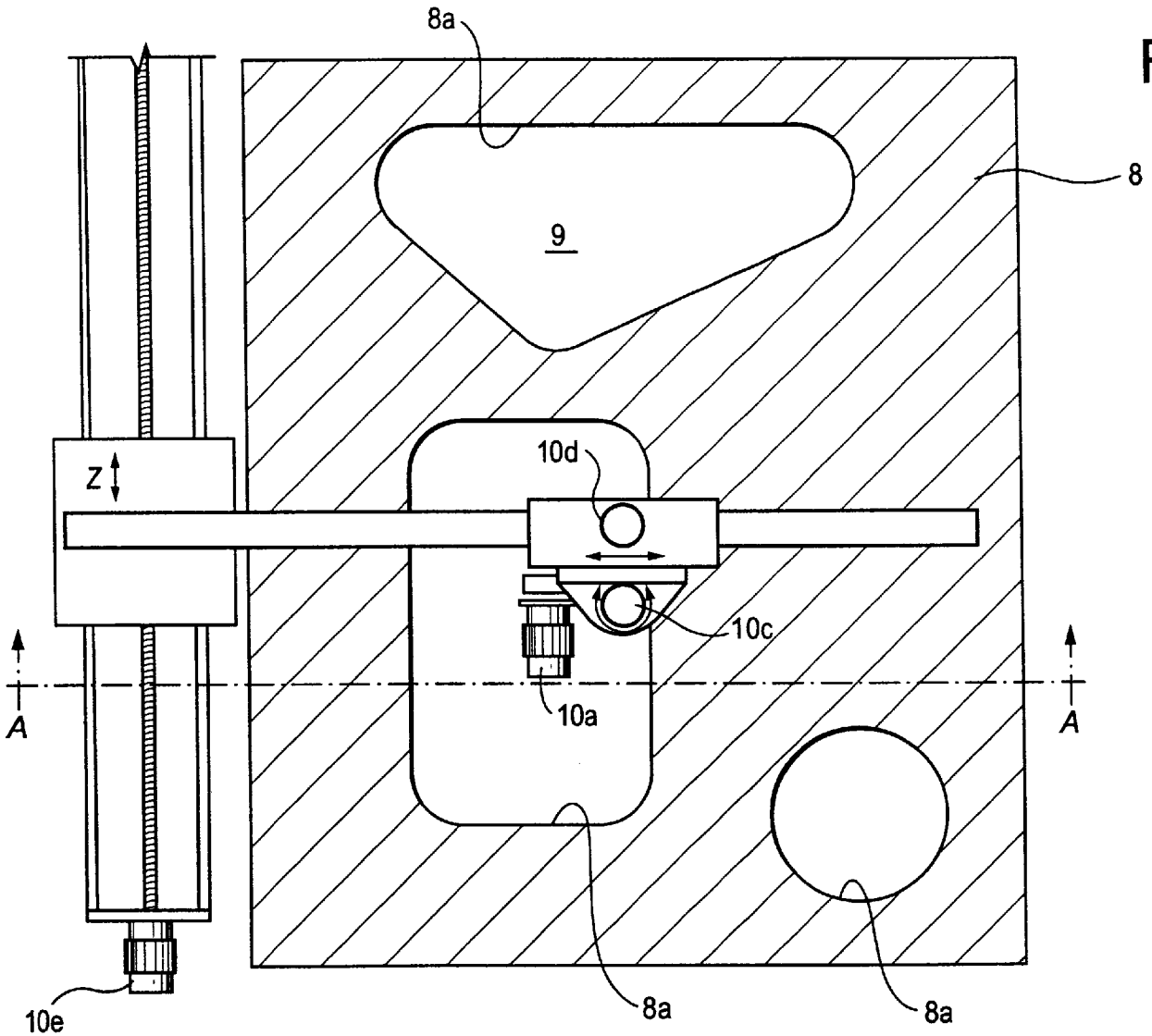
Figure 3:
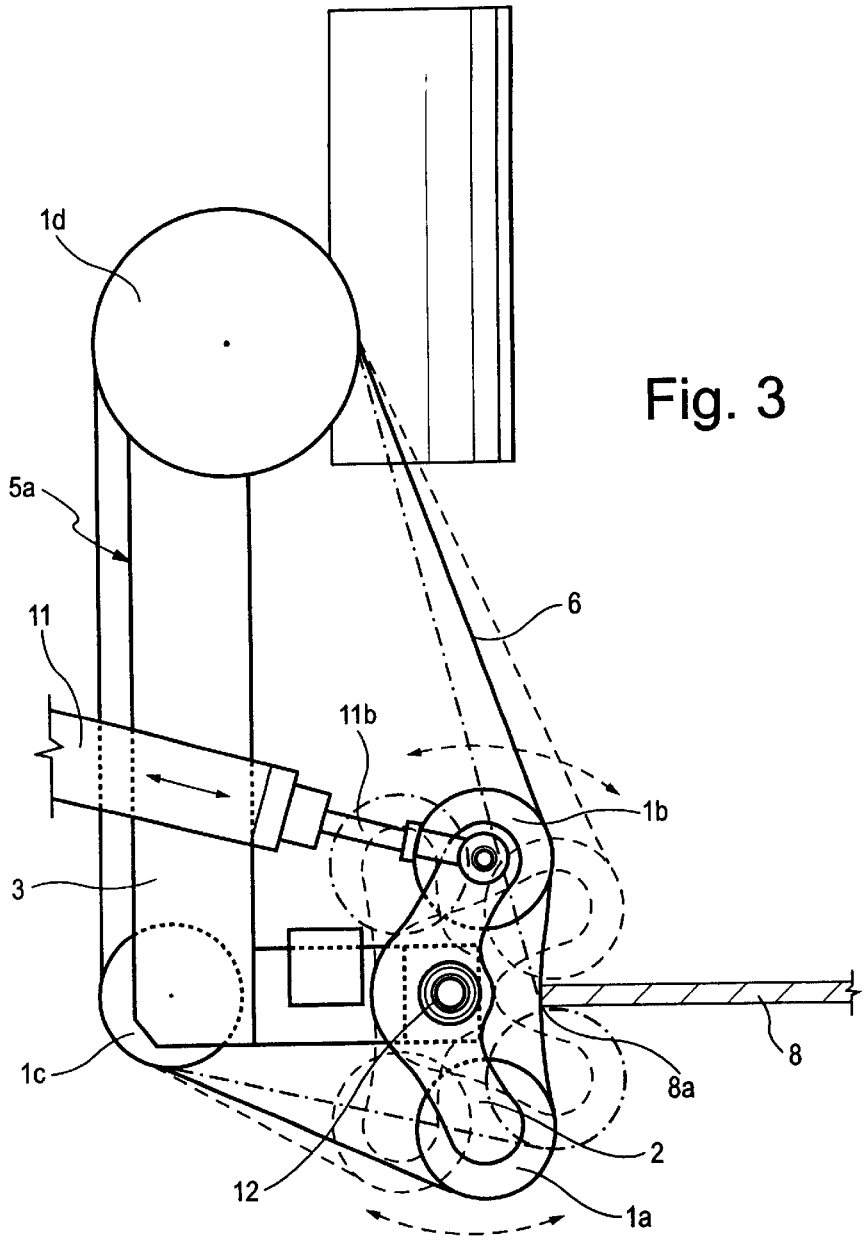
Figure 4:
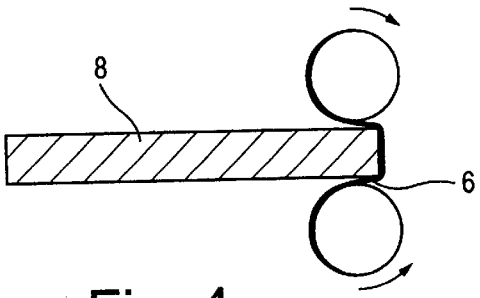
Figure 5:
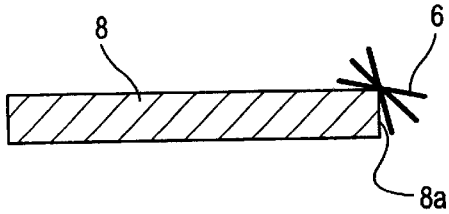

Other and further objects, features and advantages with the present invention will appear from the following description of a preferred embodiment of the invention, which is given for the purpose of description, without thus being limiting, and given together with the appended drawings, where:

FIG. 1 shows schematically a side view of the edge rounding device according to the invention, mounted to a co-ordinate machine, FIG. 2 shows the edge rounding device of FIG. 1 viewed from above, FIG. 3 shows schematically the edge rounding device proper in more detail and where the oscillating movement of the cradle is illustrated, FIG. 4 shows schematically how a typical edge grinding operation of wood work isproceeding, and FIG. 5 shows schematically what is mandatory when edge grinding metal.

FIG. 1 shows a device 5 for rounding off edges of openings 9 in a work piece 8. The device 5 for edge rounding is mounted to a co-ordinate machine 20 having a co-ordinate table 21 on which the work piece 8 is supported. The edge rounding off device 5 comprises a grinding belt machine Sa, which in turn includes a continuous grinding belt 6 running over several belt guiding rollers 1*a*, 1*b*, 1*c*, 1*d*. The upper belt guiding roller 1*d* is connected to a motor 10*a* that provides for the drive of the grinding belt 6. The further rollers 1*a*, 1*b*, 1*c* are belt guiding only and omit drive. The upper roller 1*d* and the lower guiding roller 1*c* are mounted to the frame 3 of the grinding belt machine. The two remaining belt guiding rollers 1*a*, 1*b* are connected to the frame 3 via a cradle 2 that is pivotal about a support 12 in the frame 3. By means of a linear motor 11 the cradle 2 may be given an oscillating movement P about the support 12 in order to alter the angle of attack and point of attack of the grinding belt 6 against the plate edge 8*a*.

It is also possible to provide a counter support 13, or a so called grinding shoe, behind the grinding belt 6 and between the belt guiding rollers 1*a*, 1*b* on the cradle 2. This is to ensure as much as possible rectilinear movements of the grinding belt 6. The counter support 13, however, do not appears to be a mandatory necessity because the tension in the grinding belt 6 will be substantial. Omit the counter support 13 the grinding belt 6 will run somewhat resilient between the rollers 1*a*, 1*b* when the belt 6 is pressed against the edge 8*a* of the work piece.

FIG. 2 shows the edge rounding off device 5 viewed from above and where the motor 10*a* clearly appears. Also different types of plate openings 9, which easily can be ground by the edge rounding off device 5, are indicated.

FIG. 3 shows in closer detail a grinding process with internal edge rounding of the openings 9 by means of a grinding head in form of the cradle 2 with associated rollers 1*a*, 1*b*. The grinding belt 6 runs over the upper driving wheel 1*d* and the two belt guiding wheels 1*b*, 1*a* and around the turning wheel 1*c*. The two moveable belt guiding wheels 1*a*, 1*b* fixed to the cradle 2 are moved by means of the linear motor 11 so that the cradle 2 is able to perform an oscillating movement P or rocking movement. This principle makes it possible to round off the edge 8*a* of the opening 9 both on the top side and under side by use of a stiff grinding belt 6. A telemeter (not shown) can be mounted on the support frame 3 of the belt grinding machine 5*a* for continuous measurement of the distance to the plate edge 8*a* for proper positioning of the cradle 2 in respect of the plate edge 8*a*.

If the plate is thick, like several cm, a repositioning of the belt grinder 5*a* will be necessary when the next plate edge is to be ground. This implies that the support 12 has to be adjustable in the vertical direction in respect of the frame 3 and the work piece 8. This is not illustrated.

In the one position where the arm 11*b* of the linear motor 11 is completely extended, the cradle 2 with the upper guiding roller 1*b* is advanced and bends the grinding belt 6 around the upper sharp edge of the plate edge 8*a*. The lower guiding roller 1*a* is correspondingly moving away from the plate edge 8*a*. Contrary, when the linear motor 11 retracts the arm 11*b* thereof, the cradle 2 is moving the lower guiding roller 1*a* forward and bends the grinding belt 6 around the lower sharp edge of the plate edge 8*a* Correspondingly is the upper guiding roller 1*b* moving away from the plate edge 8*a*. In operation, this alternation between extreme positions will be repeated simultaneously with that the grinding head is moving along the contour of the opening 9.

As shown in FIGS. 1 and 2, the edge rounding off machine 5 is mounted to a co-ordinate machine 20. The co-ordinate machine 20 can be moved by means of a motor 10*b* in the x-direction, by means of a motor 10*d* in the y-direction, by means of a motor 10*c* in a pivoting direction about a vertical axis, and by means of a motor 10*e* in the z-direction. However, it is to be understood that the co-ordinate table 21 in stead to be stationary, can be displaced in one or more of the above mentioned x, y and z-directions. This will be a pure choice of the man skilled in the art.

The co-ordinate machine 20 can be controllable like a CNC machine based on that the parameters from the drawings for cutting of the plate 8 are installed in the software.

In order to emphasize clearly why the technique from the furniture industry is not transferable to metal materials, it is referred to FIGS. 4 and 5. FIG. 4 shows the simplest way to grind goods when edges are to be rounded off and when it is wood work that is to be ground. This method is used in wide extent at present, but can not be used on steel materials. FIG. 5 shows what the background is for the proposed grinding process and indicates the positions a stiff grinding belt 6 will adapt as the working cylinder alters the position of the cradle 2. Thus one may still use the requisite stiff grinding belt 6 because the belt do not need to be bent substantially around any plate edge 8*a*.

What is claimed is:

1. An apparatus for rounding off edges of openings or cut-outs in a work piece, comprising a belt grinding machine having a continuous grinding belt running over several belt guiding rollers which are provided on a support frame, wherein two of the rollers are disposed on a cradle, which cradle is pivotally supported in the support frame, the grinding belt between the rollers on the cradle runs substantially rectilinear whereby a grinding point of the belt is defined between the two rollers, and means are provided for operating the cradle about the pivotal support during a grinding operation whereby upper and lower work piece edges are ground in the same grinding operation.

2. An apparatus according to claim 1, wherein a counter support is provided behind the grinding belt and between the belt guiding rollers on the cradle.

3. An apparatus according to claim 1, wherein the cradle is adjustable in the vertical direction (y) and is symmetric about a horizontal plane extending through the pivotal axis of the cradle.

4. An apparatus according to claim 1, wherein the operating means is a linear motor, which at one end thereof is fixed to the support frame and at the other end thereof is pivotally fixed to the cradle.

5. An apparatus according to claim 4, wherein the linear motor is in the form of a double acting working cylinder that actively causes an oscillating movement of the cradle by extending and retracting the piston rod of the working cylinder.

6. An apparatus according to one of the claim 1, wherein the belt grinding machine comprises an upper and lower guiding wheel on the cradle, an upper driving wheel, and a lower turning wheel mounted to the support frame.

7. An apparatus according to one of the claim 1, wherein the support frame is provided with a telemeter for continuous measurement of the distance to the plate edge for proper positioning of the cradle in respect of the plate edge.

8. An apparatus according to one of the claim 1, wherein the belt grinding machine is mounted to a co-ordinate machine having a co-ordinate table for the work piece.

9. An apparatus according to claim 8, wherein the belt grinding machine in the co-ordinate machine is displaceable in the x, y and z-direction.

10. An apparatus for rounding off edges of openings or cut-outs in a work piece, comprising:

a belt grinding machine having a continuous grinding belt running over several belt guiding rollers which are provided on a support frame, two of the rollers being arranged on a cradle that is pivotally supported in the support frame, the grinding belt between the rollers on the cradle running substantially rectilinear for working off the work piece, a mechanism for pivoting the cradle about its pivotal support during a grinding operation, and a counter support provided behind the grinding belt and between the belt guiding rollers on the cradle.

11. An apparatus according to claim 10, wherein the cradle is adjustable in the vertical direction (y) and is symmetric about a horizontal plane extending through the pivotal axis of the cradle.

12. An apparatus according to claim 10, wherein the operating means is a linear motor, which at one end thereof is fixed to the support frame and at the other end thereof is pivotally fixed to the cradle.

13. An apparatus according to claim 12, wherein the linear motor is a double acting working cylinder that actively causes an oscillating movement of the cradle by extending and retracting the piston rod of the working cylinder.

14. An apparatus for rounding off edges of openings or cut-outs in a work piece, comprising a belt grinding machine having a continuous grinding belt running over several belt guiding rollers which are provided on a support frame, wherein two of the rollers are arranged on a cradle that is pivotally supported in the support frame, the grinding belt between the rollers on the cradle running substantially rectilinear for working off the work piece, and a mechanism for pivoting the cradle about its pivotal support during a grinding operation, and wherein the belt grinding machine comprises an upper and lower guiding wheel on the cradle, an upper driving wheel and a lower turning wheel mounted to the support frame.

15. An apparatus according to claim 14, wherein the cradle is adjustable in the vertical direction (y) and is symmetric about a horizontal plane extending through the pivotal axis of the cradle.

16. An apparatus according to claim 14, wherein the operating means is a linear motor, which at one end thereof is fixed to the support frame and at the other end thereof is pivotally fixed to the cradle.

17. An apparatus according to claim 16, wherein the linear motor is a double acting working cylinder that actively causes an oscillating movement of the cradle by extending and retracting the piston rod of the working cylinder.

18. An apparatus according to one of the claim 14, wherein the support frame is provided with a telemeter for continuous measurement of the distance to the plate edge for proper positioning of the cradle in respect of the plate edge.

19. An apparatus according to one of the claim 14, wherein the belt grinding machine is mounted to a co-ordinate machine having a co-ordinate table for the work piece.

20. An apparatus according to claim 19, wherein the belt grinding machine in the co-ordinate machine is displaceable in the x, y and z-direction.

* * * * *